US005921475A

United States Patent [19]

DeVriese et al.

[11] Patent Number: 5,921,475

[45] Date of Patent: Jul. 13, 1999

[54] AUTOMOTIVE FUEL INJECTOR

[75] Inventors: Darren Matthew DeVriese, Ann Arbor; Kenneth Lyle Rische, Brighton; Victor Dobrin, Ypsilanti, all of Mich.; Kenneth Charles LePage, Williamsburg, Va.

[73] Assignee: Ford Motor Company, Dearborn, Mich.

[21] Appl. No.: 08/908,276

[22] Filed: Aug. 7, 1997

[51] Int. Cl.[6] ..... F02M 57/00

[52] U.S. Cl. ..... 239/585.4

[58] Field of Search ..... 269/167, 180, 269/166; 234/533.1, 533.52, 585.5; 251/129.15, 129.21

[56] References Cited

U.S. PATENT DOCUMENTS

| | | | |
|---|---|---|---|
| 2,091,842 | 8/1937 | West | 267/166 |
| 3,301,492 | 1/1967 | Kingsley | 239/533.9 |
| 3,627,209 | 12/1971 | Scott | 239/533.9 |
| 3,777,984 | 12/1973 | Greathouse . | |
| 4,077,619 | 3/1978 | Borlinghams | 267/166 |
| 4,345,717 | 8/1982 | Clark et al. | 239/533.9 X |
| 4,530,337 | 7/1985 | Laufer . | |
| 5,071,325 | 12/1991 | Tupper et al. . | |
| 5,127,585 | 7/1992 | Mesenich | 239/585.5 |
| 5,238,192 | 8/1993 | McNair . | |
| 5,263,649 | 11/1993 | Babitzka et al. . | |
| 5,330,649 | 7/1994 | Hafner . | |
| 5,340,032 | 8/1994 | Stegmaier et al. | 239/575 |
| 5,356,079 | 10/1994 | Rahbar . | |
| 5,392,994 | 2/1995 | Zizelman et al. . | |
| 5,423,489 | 6/1995 | Wood . | |
| 5,465,911 | 11/1995 | Hall . | |
| 5,520,338 | 5/1996 | Lohmann . | |

FOREIGN PATENT DOCUMENTS

| | | | |
|---|---|---|---|
| 1055227 | 4/1952 | France | 239/533.9 |

*Primary Examiner*—Kevin Weldon
*Attorney, Agent, or Firm*—Neil P. Ferraro

[57] ABSTRACT

An electromagnetically actuated fuel injector supplies fuel to an internal combustion engine. The injector has a body with an inlet and a nozzle. A needle valve is selectively moveable within the body in response to actuation of the fuel injector. A reduced center-body coil spring is disposed within the fuel injector and biases the needle valve in a closed position. The reduced center-body coil spring has a substantially hour glass shape to prevent rubbing with the components of the fuel injector.

12 Claims, 3 Drawing Sheets

AUTOMOTIVE FUEL INJECTOR

FIELD OF THE INVENTION

This invention relates to automotive fuel injectors, and more particularly to, needle valve biasing springs in automotive fuel injectors.

BACKGROUND OF THE INVENTION

Conventional automotive fuel injectors for an internal combustion engine include an inlet tube, a needle valve assembly, including an armature, an electromagnetic coil, a fuel delivery nozzle, and a biasing spring to bias the needle valve assembly in a closed position relative to the nozzle. When the electromagnetic coil is energized, a magnetic force is generated which operates against the action of the biasing spring to open the needle valve assembly. During fabrication and assembly of the injector, the needle valve assembly may become misaligned relative to the inlet tube, which may interfere with the biasing spring and effect the operation and durability of the injector.

In particular, the inventors of the present invention have found that this misalignment causes conventional biasing springs to rub against the sides of the inlet tube or the needle valve assembly. This may result in excess wear on the needle valve assembly or the inlet tube potentially causing a premature failure of the fuel injector. In addition, the spring itself may wear prematurely. This could change the design parameters of the fuel injector, namely the fuel injector opening force, resulting in a change in the amount of fuel delivered to engine. Prior art fuel injectors attempt to prevent the effects of this misalignment by fixing the biasing spring at one end to the inlet tube and at the other end to the needle valve assembly. This results in a relatively expensive and difficult to manufacture fuel injector. Other attempts to prevent rubbing of the biasing spring against the needle valve assembly or inlet tube (where the needle valve assembly or inlet tube includes a relief) results in a fuel injector having a larger electromagnetic coil to accommodate for the reduced magnetic force associated with reduced ferromagnetic material in the area of the biasing spring.

SUMMARY OF THE INVENTION

A object of the present invention is to improve the performance and durability of an automotive fuel injector. This object is achieved, and disadvantages of prior art approaches overcome, by providing a electromagnetically actuated fuel injector for supplying fuel to an internal combustion engine. In one particular aspect of the invention, the fuel injector includes a body defining a longitudinal axis. The body has an inlet for admitting fuel into the injector, a nozzle for injecting fuel into the engine, and a passage for delivering fuel from the inlet to the nozzle. The fuel injector also includes a needle valve selectively moveable within the body in response to selective actuation of the fuel injector. The needle valve moves between a closed position wherein the passage is restricted such that no fuel flows through the nozzle and an open position were the passage is unrestricted such that fuel may flow through the nozzle. A reduced center-body coil spring is disposed within the body of the injector and biases the needle valve in the closed position. The reduced center-body coil spring has a substantially hour glass shape to prevent rubbing of the spring within the fuel injector.

An advantage of the present invention is that a low cost fuel injector is provided.

Another advantage of the present invention is that, because any misalignment is compensated for, a more robust fuel injector design is provided.

Still another advantage of the present invention is that a fuel injector having a relatively long service life is provided.

Another, more specific, another advantage of the present invention is that accurate fuel metering may be maintained throughout the life of the fuel injector.

Yet another advantage of the present invention is that manufacturing complexity is reduced.

Other objects, features, and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENTS

Figure 1:
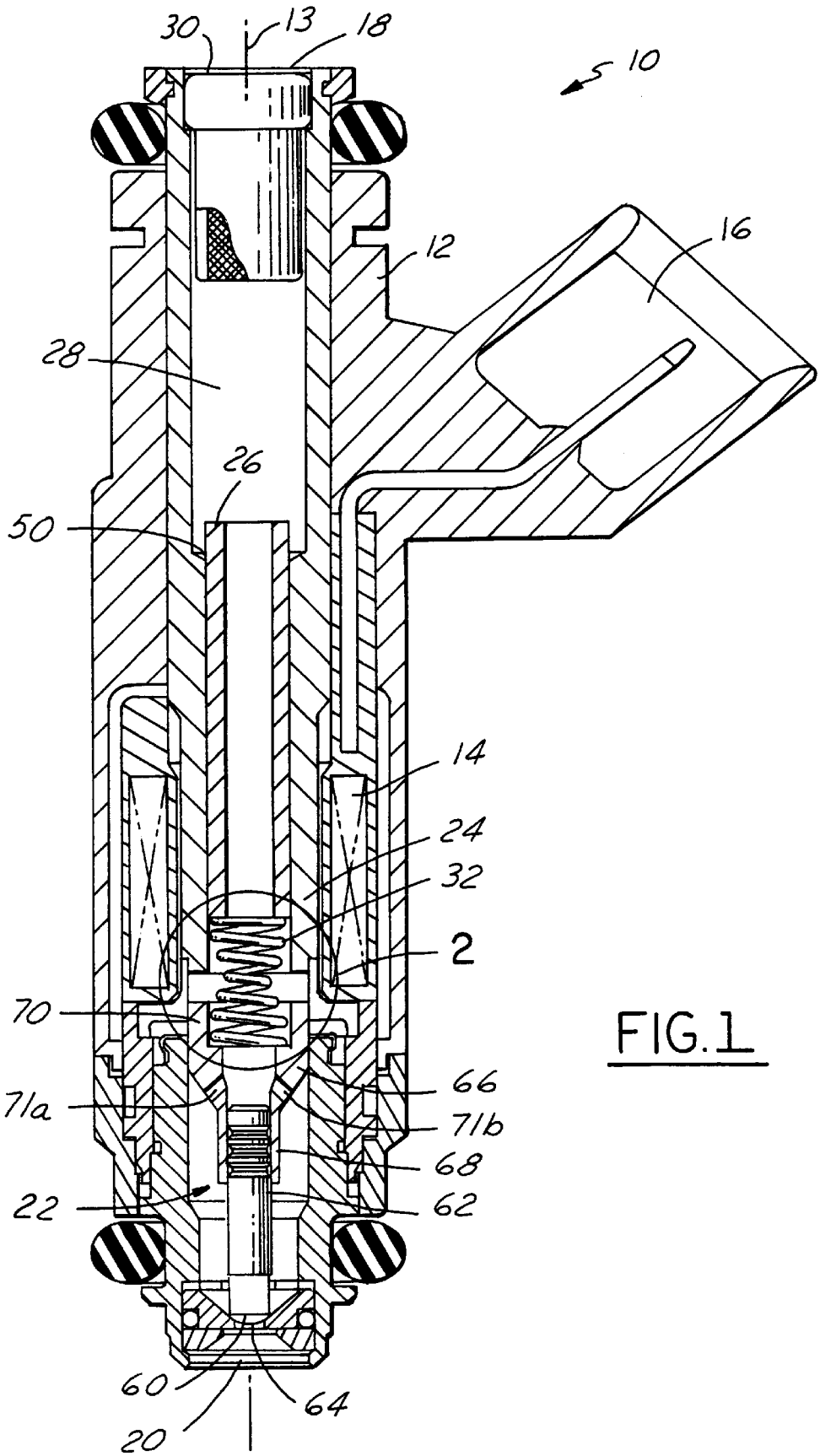
FIG. 1 is a cross-sectional view of a fuel injector according to the present invention.

Electromagnetically actuated fuel injector 10, shown in this example as a top feed injector in FIG. 1, injects fuel into an internal combustion engine (not shown). Injector 10 includes a generally cylindrical hollow body 12 defining longitudinal axis 13 and having an annular electromagnetic coil 14 coupled to connector 16, which, when in use, is coupled to an engine controller (not shown). Injector 10 also includes inlet 18, nozzle 20, needle valve assembly 22, generally cylindrical inlet tube 24 and generally cylindrical adjustment tube 26, which, together, define passage 28.

When the engine controller (not shown) commands injector 10 to actuate, a signal is sent through connector 16 to electromagnetic coil 14. A magnetic field is developed within injector 10, as is well known to those skilled in the art, to cause needle valve assembly 22 to move along axis 13 in a direction so as to allow fuel to flow from inlet 32, through passage 28 to nozzle 20. Spring 32 biases valve assembly 22 away from adjustment tube 26 such that when the electromagnetic field is interrupted, needle valve assembly 22 may seat against nozzle 20 to prevent flow of fuel through passage 28.

Figure 2A:
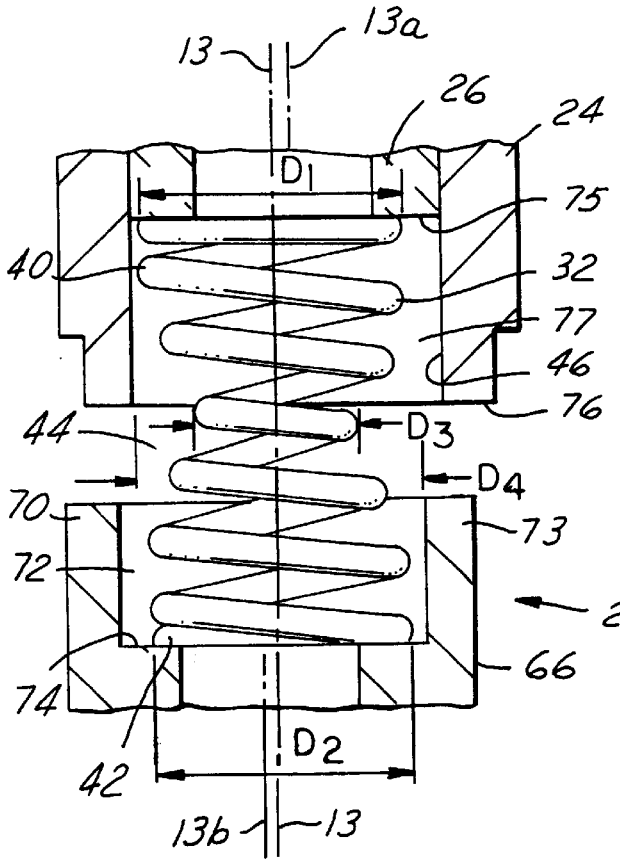
FIGS. 2*a* and 2*b* are enlarged views of the area encircled by line 2 of FIG. 1; and, FIG. 3 is a cross-sectional view of an alternative embodiment of a fuel injector according to the present invention.
Figure 2B:
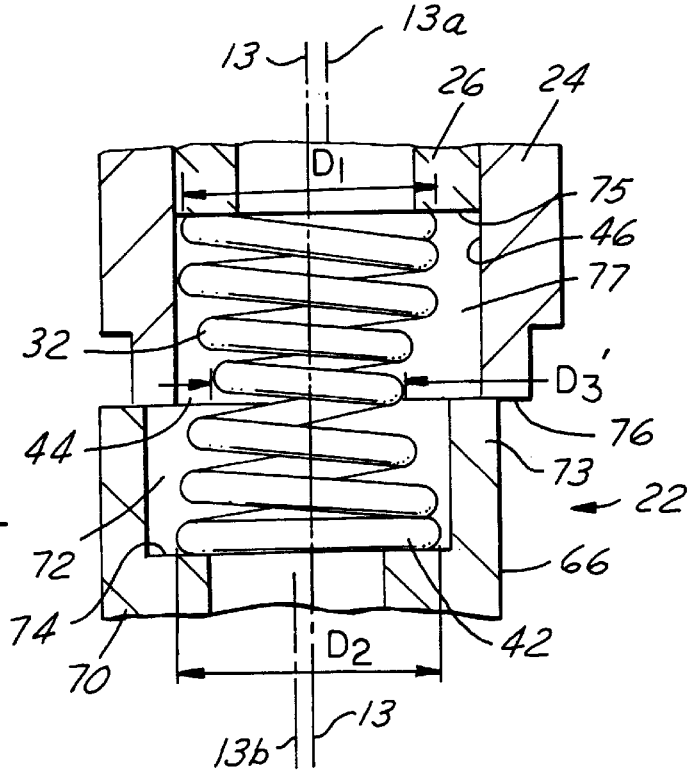

According to the present invention, as best shown in FIGS. 2*a* and 2*b,* spring 32 is a reduced center-body coil spring having a substantially hour glass shape. That is, spring 32 includes first end section 40 defining a first end diameter D1, second end section 42 defining a second end diameter D2 and middle section 44 defining middle diameter D3. Middle diameter D3 is less than both diameter D1 and diameter D2. In the example described herein, diameter D1 is substantially equal to diameter D2. Middle section 44 defines the effective working region of spring 32.

During fabrication and assembly of injector 10, needle valve assembly 22 or inlet tube 24/adjustment tube 26 assembly may become misaligned relative axis 13 as best shown by the offset axes 13*a* and 13*b,* respectively of FIGS. 2*a* and 2*b* (which shows needle valve assembly 22 in the closed and opened positions, respectively). This misalignment may result in excess wear of spring 32. To prevent this, according to the present invention, middle section 44 having diameter D3 is sufficiently small so that the misalignment will not interfere with the operation of spring 32. In addition, as spring 32 compresses, diameter D3 of middle section 44 may expand to a new diameter D3', which is sufficiently less than the effective diameter D4 (see FIG. 2*a*) so that spring 32 may not interfere with needle valve assembly 22 or inlet tube 26. In addition, according to the present invention, because spring 32 will not interfere with needle valve assembly 22 or inlet tube 26, a means of holding spring 32 in a fixed position is not necessary.

To set the spring force on spring 32, adjustment tube 26 is positioned within inlet tube 24 and is crimped at end 50 (see FIG. 1) to lock adjustment tube 26 relative to inlet tube 24. Those skilled in the art will recognize in view of this disclosure that any means of securing adjustment tube 26 to inlet tube 24 may be used. For example, adjustment tube 28 may be pressfit within inlet tube 24.

In a preferred embodiment needle valve assembly 22 includes needle valve 60 (see FIG. 1) having a longitudinally extending shaft 62 and a needle portion 64 at nozzle end 20. Nozzle end 64 sealingly engages nozzle 20. Needle valve assembly 22 further includes a generally cylindrical armature 66 having first end 68 and second end 70. First end 68 is secured to shaft 62 using any suitable fastening means such as a pressfit, a weld, a threaded coupling, or any other fastening means know to those skilled in the art and suggested by this disclosure. To allow fuel flow through needle valve assembly 22, orifices 71*a* and 71*b* may be formed in armature 66.

Referring in detail again to FIG. 2*a* and 2*b*, second end 70 of armature 66 of needle valve assembly 22 includes recess 72 defined by wall 73, extending substantially along longitudinal axis 13, and a substantially flat bottom 74 lying in a plane generally perpendicular to longitudinal axis 13. Thus, recess 72 may receive second end 42 of spring 32. Also, bottom end 75 of adjustment tube 26 does not lie in the same plane as bottom end 76 of inlet tube 24. Thus, recess 77 is formed to receive first end section 40 of spring 32. Accordingly, spring 32 lies freely adjacent bottom 75 of adjustment tube 26 and freely adjacent bottom 74 of recess 72.

Figure 3:
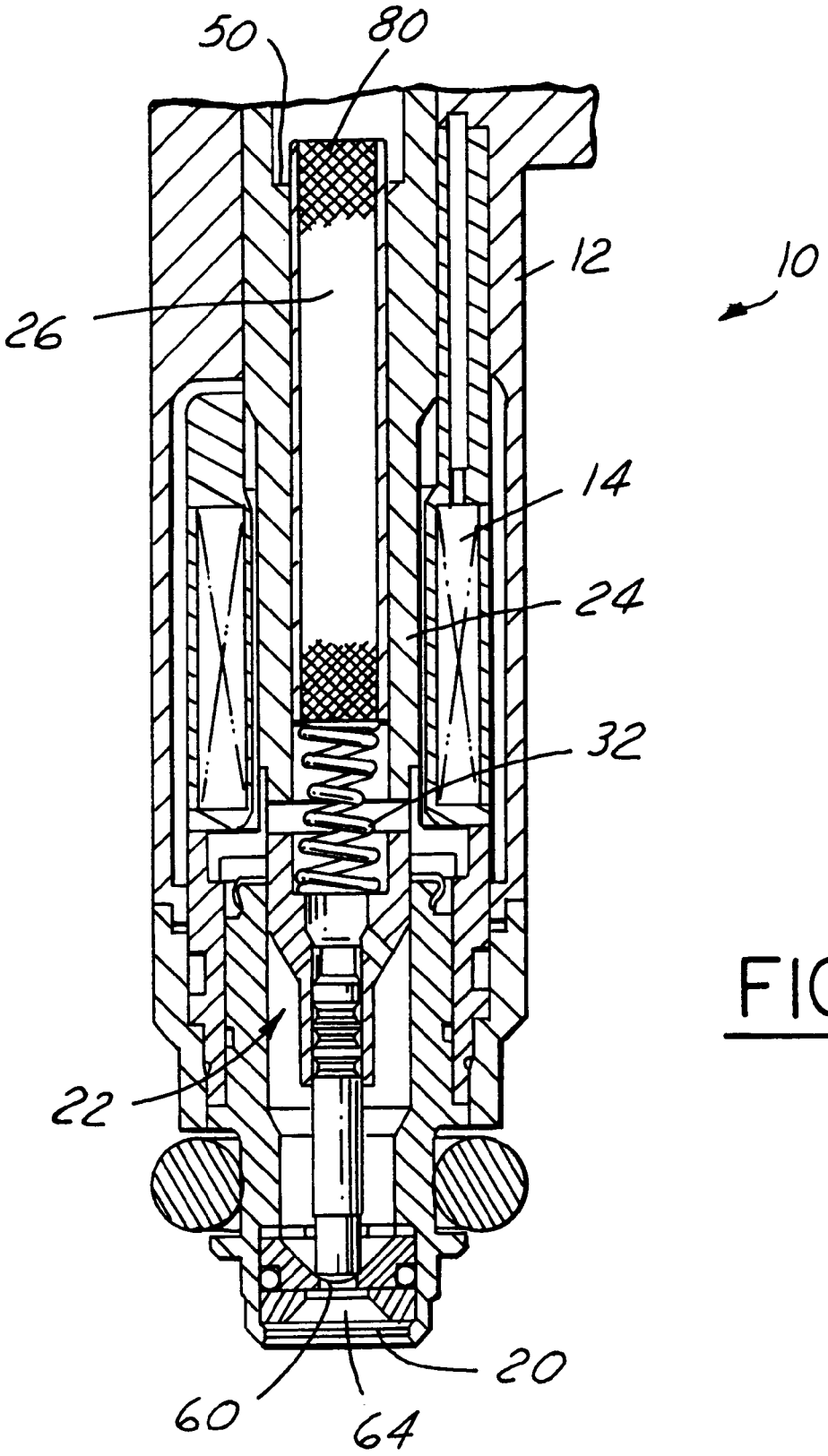

Turning now in particular to FIG. 3, injector 10 is shown with adjustment tube 26 is formed with integral fuel filter 80. Thus, the need for a separate fuel filter, typical of most fuel injectors, is obviated. As a result, a shorter fuel injector may be produced.

While the best mode in carrying out the present invention has been described in detail, those familiar with the art to which this invention relates will recognize various alternative designs and embodiments, including those mentioned above, in practicing the invention as defined by the following claims.

We claim:

1. An electromagnetically actuated fuel injector for supplying fuel to an internal combustion engine comprising:

a body defining a longitudinal axis, with said body having an inlet for admitting fuel into said injector, a nozzle for injecting fuel into the engine, and a passage for delivering fuel from said inlet to said nozzle;

a needle valve selectively moveable within said body in response to selective actuation of said fuel injector, with said needle valve moving between a closed position wherein said passage is restricted such that no fuel flows through said nozzle and an open position wherein said passage is unrestricted such that fuel may flow through said nozzle; and, a stemless open reduced center-body coil spring disposed within said body and biasing said needle valve in said closed position, with said reduced center-body coil spring having a substantially hour-glass shape said hour-glass shape providing radial clearance to said body.

2. A fuel injector according to claim 1 wherein said hour-glass shape is defined by a first end section defining a first end diameter, a second end section defining a second end diameter, and a middle section between said first and second end sections defining a middle diameter, with said middle diameter being less than said both said first and second end diameters.

3. A fuel injector according to claim 2 wherein said first and second end diameters are substantially equal.

4. A fuel injector according to claim 1 further comprising an adjustment tube disposed within said passage, with said adjustment tube being set at a position within said passage so as to set the spring force on said reduced center-body coil spring, with said reduced center-body coil spring biasing said needle valve away from said adjustment tube.

5. A fuel injector according to claim 4 wherein said passage is defined by a inlet tube disposed within said body and a portion of said needle valve, with said reduced center-body coil spring freely lying adjacent an end face of said needle valve and freely lying adjacent an end face of said adjustment tube, with said middle section effectively remaining a distance away from said inlet tube so as to prevent rubbing against said inlet tube, as said fuel injector is actuated.

6. A fuel injector according to claim 4 wherein said adjustment tube comprises a fuel filter, with said fuel filter being positioned at a predetermined depth, relative to said inlet, to set a corresponding predetermined force on said reduced center-body coil spring.

7. An electromagnetically actuated fuel injector for supplying fuel to an internal combustion engine comprising:

a body defining a longitudinal axis, with said body having an inlet for admitting fuel into said injector, a nozzle for injecting fuel into the engine, and an internal passage for delivering fuel from said inlet to said nozzle;

an annular electromagnetic coil disposed within said body;

a needle valve selectively moveable within said body in response to selective energizing and deenergizing said electromagnetic coil, with said needle valve moving between a closed position wherein said internal passage is restricted such that no fuel flows through said nozzle and an open position wherein said internal passage is unrestricted such that fuel may flow through said nozzle; and, a stemless open reduced center-body coil spring disposed within said body and biasing said needle valve in said closed position, with said reduced center-body coil spring having a first end section defining a first end diameter, a second end section defining a second end diameter, and a middle section between said first and second end sections defining a middle diameter providing radial clearance to said body, with said middle diameter being less than said both said first and second end diameters and with said first and second end diameters being substantially equal.

8. A fuel injector according to claim 7 further comprising an adjustment tube disposed within said internal passage in said body, with said adjustment tube being set at a position within said internal passage so as to set the spring force on said reduced center-body coil spring, with said reduced center-body coil spring biasing said needle valve away from said adjustment tube.

9. A fuel injector according to claim 8 wherein said internal passage is defined by an inlet tube disposed within said body and a portion of said needle valve, with said reduced center-body coil spring freely lying adjacent an end face of said needle valve and freely lying adjacent an end face of said adjustment tube, with said middle section effectively remaining a distance away from said inlet tube so as to prevent rubbing against said inlet tube, as said fuel injector is actuated.

10. A fuel injector according to claim 8 wherein said adjustment tube comprises a fuel filter, with said fuel filter being positioned at a predetermined depth, relative to said inlet, to set a corresponding predetermined force on said reduced center-body coil spring.

11. A top-feed electromagnetically actuated fuel injector for supplying fuel to an internal combustion engine comprising:

a generally cylindrical hollow body defining a longitudinal axis, with said body having an inlet located at a first end thereof for admitting fuel into said injector, and a nozzle disposed at a second end thereof longitudinally opposite said first end for injecting fuel into the engine;

an annular electromagnetic coil disposed within said body for providing, when energized, an electromagnetic field;

a generally cylindrical inlet tube disposed within said body and defining an internal passage for allowing fuel to flow from said inlet to said nozzle, with said inlet tube cooperating with said electromagnetic field to open said fuel injector;

a needle valve assembly selectively moveable within said body in response to selective actuation of said electromagnetic coil, with said needle valve assembly moving between a closed position wherein said internal passage is restricted such that fuel may not flow through said nozzle and an open position wherein said internal passage is unrestricted such that fuel may flow through said nozzle, with said needle valve assembly comprising:

a needle valve having a longitudinally extending shaft and a needle portion at a nozzle end of said shaft, with said needle portion sealingly engaging said nozzle when said electromagnetic coil is deenergized;

a generally cylindrical armature having first and second ends, with said first end being attached to said shaft of said needle valve, with said second end having a recess defined by a wall extending substantially along said longitudinal axis and a substantially flat bottom substantially lying in a plane generally perpendicular to said longitudinal axis;

an adjustment tube having an end face and being disposed within said inlet tube at a predetermined position to set a corresponding predetermined biasing force on said needle valve assembly;

a stemless open reduced center-body coil spring freely lying adjacent said bottom of said recess formed in said armature of said needle valve assembly and freely lying adjacent said end face of said adjustment tube to bias said needle valve assembly in said closed position away from said adjustment tube, with said reduced center-body coil spring having a first end section defining a first end diameter, a second end section defining a second end diameter, and a middle section between said first and second end sections defining a middle diameter, with said middle diameter being less than both said first and second end diameters and with said first and second end diameters being substantially equal, with said middle section effectively remaining a distance away from said inlet tube so as to provide radial clearance and prevent rubbing against said inlet tube, as said fuel injector is repeatedly actuated.

12. A fuel injector according to claim 11 wherein said adjustment tube comprises a fuel filter, with said fuel filter being positioned at a predetermined depth, relative to said inlet, to set a corresponding predetermined force on said reduced center-body coil spring.

* * * * *